United States Patent [19]

Azimi

[11] Patent Number: 4,694,629

[45] Date of Patent: Sep. 22, 1987

[54] MODULAR BLOCK AND MODULAR STRUCTURAL ELEMENTS CONSTRUCTED THEREFROM

[76] Inventor: Hossein Azimi, Box 1690, Rolla, Mo. 65401

[21] Appl. No.: 766,777

[22] Filed: Aug. 16, 1985

[51] Int. Cl.[4] ..... E04B 5/04

[52] U.S. Cl. ..... 52/611; 52/228

[58] Field of Search ..... 52/608, 611, 227, 228

[56] References Cited

U.S. PATENT DOCUMENTS

| | | | |
|---|---|---|---|
| 3,472,031 | 10/1969 | Kelso | 52/227 X |

FOREIGN PATENT DOCUMENTS

| | | | |
|---|---|---|---|
| 17269 | of 1929 | Australia | 52/611 |
| 257119 | 4/1964 | Austria | 52/227 |
| 761196 | 6/1967 | Canada | 52/227 |
| 812597 | 9/1951 | Fed. Rep. of Germany | 52/611 |
| 853061 | 10/1952 | Fed. Rep. of Germany | 52/611 |
| 1451580 | 7/1965 | France | 52/227 |
| 383786 | 7/1973 | U.S.S.R. | 52/227 |

*Primary Examiner*—Carl D. Friedman
*Assistant Examiner*—Naoko N. Slack
*Attorney, Agent, or Firm*—Rogers, Howell, Moore & Haferkamp

[57] ABSTRACT

A modular block for engagement to a plurality of similar blocks arranged in a line to form a structural element, the modular blocks being engaged to each other by tension members extending through the blocks. The configuration of the structural element can be easily modified by substituting special blocks. The block has a generally hollow, T-shaped cross-section with an axial hole extending therethrough. The block further has three axial passages for receiving tension members, the passages arranged in a triangular pattern to withstand the high shear and torsional stresses encountered during erection and in service.

10 Claims, 12 Drawing Figures

MODULAR BLOCK AND MODULAR STRUCTURAL ELEMENTS CONSTRUCTED THEREFROM

This invention relates to a modular block that can be used to make larger structural elements, and structural elements made from modular blocks.

BACKGROUND OF THE INVENTION

Large, prefabricated structural elements such as beams are widely used in modern construction. These elements, which are typically cast in one piece from concrete, are prestressed under compressive loading so that the elements can bear greater tensile stresses while in service. The prefabricated elements are prefabricated and shipped to the construction site because it is too difficult, time consuming, and expensive to manufacture the elements at the construction site. The prefabricated elements are bulky and heavy and thus are very difficult and expensive to transport. The size of the elements is limited to those that can be economically transported. The elements are also difficult to handle and store at the construction site. These problems are compounded by the fact that the elements are cast solid and thus are very heavy.

The large castings required to make the elements are difficult and expensive to make. Any variations in configuration or even size are very difficult and expensive. Thus, designers and builders have only a limited choice of standard structural element configurations and sizes to work with.

SUMMARY OF THE INVENTION

The present invention is a modular block that is specifically adapted to be assembled into larger stable structural elements. The modular block has a generally hollow, T-shaped cross-section. The block has a central stem and two oppositely facing legs. There is a hole extending axially through the block. There are at least three axially extending passages in the block for receiving tension members. These passages are arranged in a triangular pattern, with one passage in the stem and the other passages adjacent each leg.

The modular blocks can be arranged in a line, end to end, with their axial passages aligned. Tension members, such as metal cables or metal rods, can be positioned in the aligned axial passages in the modular blocks. The tension member can be engaged to the block at each end of the line and tensioned to compress the modular blocks, holding them together and putting them under a compressive prestress. The tension members can be tensioned with any of the present post-tensioning methods such as strand systems, for example FRYSSINET TM or STRESSTEK TM, or bar systems, for example STRESSTEEL TM or DWIDAG TM, all of which are well known in the art.

The modular blocks are much smaller than the prefabricated structural elements, and can be much more easily and less expensively made than the structural elements. Special structural elements for particular applications can be quickly, easily, and inexpensively made by substituting special blocks for the modular blocks. Since the construction of structural elements is based upon one basic modular block, mass production and automated manufacturing techniques can be used to further reduce the cost of manufacturing these blocks. The blocks are also much easier and less expensive to transport, store, and handle than the completed structural elements. The modular blocks can be made with holes or relieved portions in areas of low stress to reduce the amount of the material required to make the blocks and to reduce their weight while maintaining a high moment of inertia. This makes the blocks easier and less expensive to transport, store, and handle, and results in structural elements of reduced weight.

Structural elements can be easily, quickly, and inexpensively assembled at the construction site. The structural elements can be made to any desired size by using the appropriate number of modular blocks. The configuration of the structural element can be easily modified by substituting special blocks for some of the modular blocks in the beam. These special blocks may be, for example, blocks with projecting threaded studs or holes so that the beams and other structural members can be interconnected, or blocks with depending mounting feet for mounting the beams. Special blocks may also be provided with transverse passages so that adjacent blocks on adjacent elements can be joined and prestressed or so that crossmembers formed from additional blocks can be assembled between adjacent elements.

Large structural elements can be easily and inexpensively assembled from the relatively small, lightweight, easy-to-handle modular blocks. The modular blocks can be conveniently transported to the construction site where they are much easier to store and handle than prefabricated structural elements. The structural elements are quickly assembled by arranging the modular blocks in a line with their axial passages aligned, positioning tension members in the aligned axial passages in the blocks, engaging the tension member to the blocks at each end of the line, and tensioning the tension member to hold the blocks together and put the blocks under a compressive prestress. Well-known and readily available tensioning systems can be used to tension the tension members. Workers will already be familiar with these systems and the equipment will already be available at the construction site.

Because special blocks can be substituted for the modular blocks, structural elements can be easily, quickly, and inexpensively tailored to the designer's or builder's requirements. These special blocks can include blocks with threaded studs and holes so that the structural elements can be engaged to each other. The special blocks can also include blocks provided with mounting feet for mounting the elements on supports. These special blocks can also include blocks with transverse passages so that adjacent blocks on adjacent elements can be joined and prestressed or so that crossmembers can be formed between adjacent elements.

DETAILED DESCRIPTION OF THE PREFERRED EMBODIMENT

Figure 1:
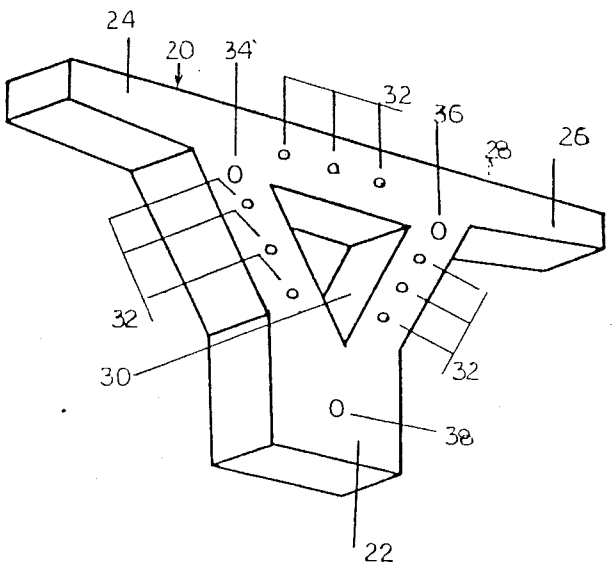
FIG. 1 is a perspective view from below of one of the modular blocks of this invention, from which the structural elements of this invention may be constructed.

A modular block constructed according to the principles of this invention is indicated generally as 20 in FIG. 1. Modular block 20 can be constructed from any material that meets the required strength specifications, but will preferably be reinforced normal concrete, reinforced lightweight concrete, compressed reinforced mortared cement, reinforced materials, or reinforced aerated concrete. Because large numbers of identical blocks 20 can be used to make a wide variety of beam configurations and sizes, the blocks 20 can be made by mass production and automated production processes.

In cross-section, the modular blocks 20 have a base section wider than the rest of the block. As shown in FIG. 1, the block 20 preferably has a generally hollow T-shaped configuration. In this case the top of the "T" forms the base which is wider than the rest of the block. The blocks 20 have a central stem 22 and two oppositely directed colinear legs 24 and 26, extending therefrom. The top of the modular blocks 20 preferably have a generally flat surface 28. The modular blocks 20 have a hollow cross-section to reduce weight while maintaining a relatively high moment of inertia. In the preferred embodiment, the modular blocks 20 have a generally triangular hole 30 extending axially therethrough. One side of the triangular hole 30 is generally parallel to the top of the "T". It may also be desirable to make this hole round to avoid stress concentration. Additional holes 32 may be provided adjacent to triangular hole 30 in areas of low stress. Holes 30 and 32 reduce the weight of the blocks 20, making them easier and less expensive to transport and handle, and giving them a greater moment of inertia per unit weight.

Figure 3:
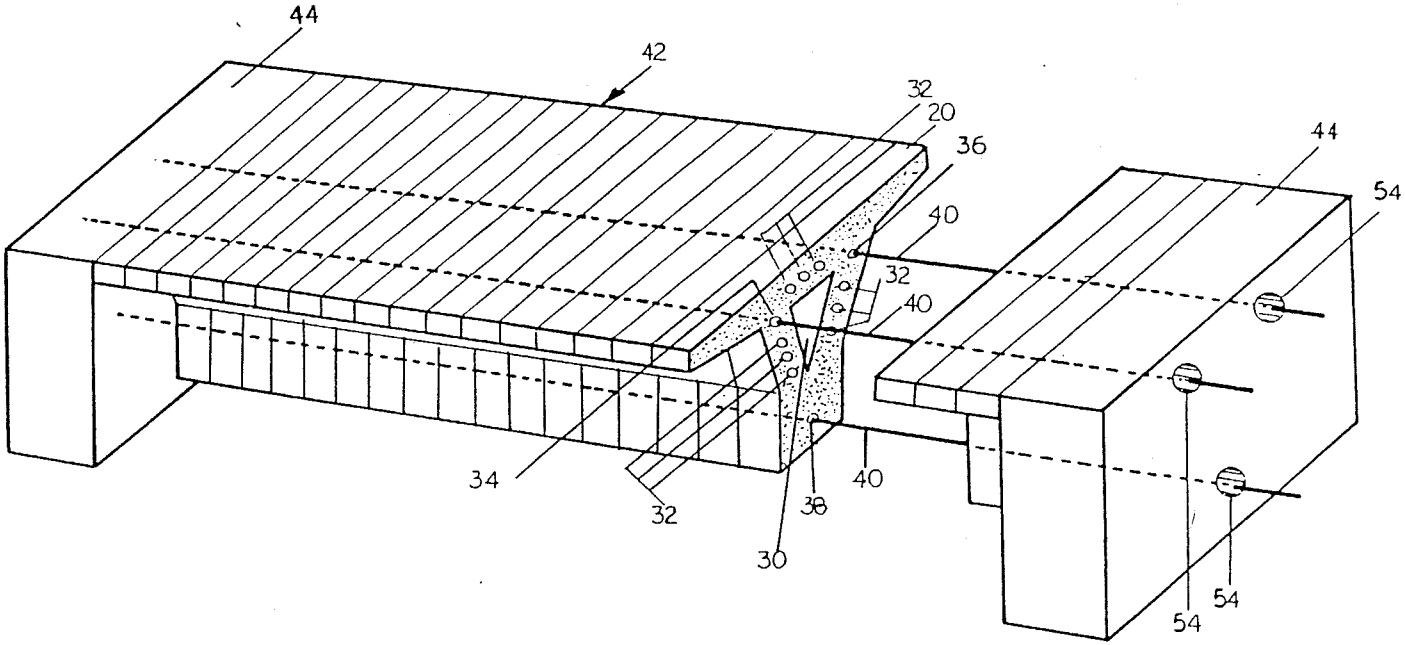
FIG. 3 is a perspective view from above of a structural element according to this invention, constructed from the modular blocks, with several blocks removed to show the construction.

The modular blocks 20 have three axially extending passages 34, 36, and 38, arranged in a triangular pattern. As shown in FIG. 3, passages 34, 36, and 38, accommodate tension members 40 for holding the blocks together to form a structural element as described below. The tension members are arranged in a triangular pattern to withstand the high shear and torsional stresses encountered during the assembly and erection of the structural element from the blocks, as well as the stresses encountered while the assembled structural element is in service.

A modular structural element constructed from the modular blocks 20 of this invention is indicated generally as 42 in FIG. 3. Element 42 is comprised of a plurality of blocks 20 arranged in a line, with a special end block 44 at each end of the line.

Figure 2:
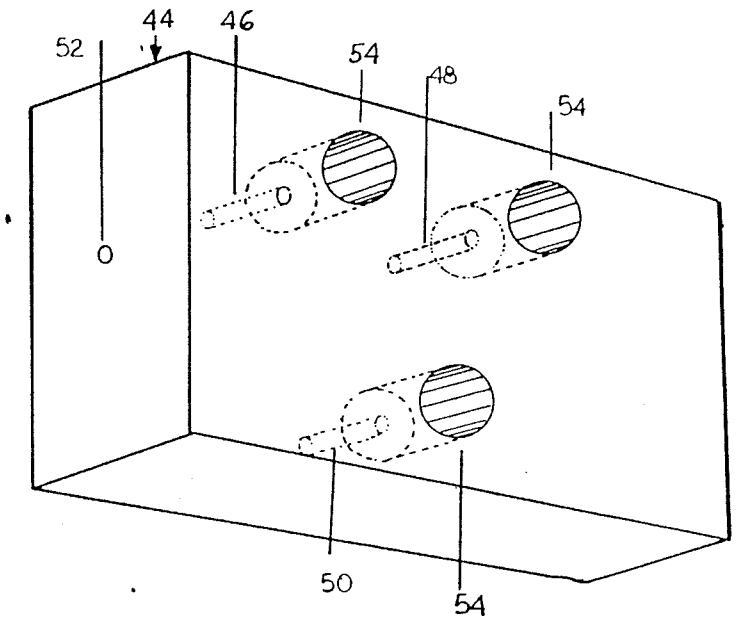
FIG. 2 is a perspective view from below of a special end block which can be included in the structural elements.

One of the special end blocks 44 is shown in FIG. 2. The special end block 44 is shaped generally like a rectangular prism. Each special end block 44 serves to engage and space the tension members 40. The special end block 44 may be cast from the same material as the modular blocks 20 or can be made from some other material, for example steel, capable of withstanding the concentrated stresses exerted by the tension members 40. The special end blocks 44 have three axially extending passages 46, 48, and 50, arranged in a triangular pattern complementary to the arrangement of the passages 34, 36, and 38 in the modular blocks 20. Thus, passages 46, 48, and 50 in one end block 44 can be aligned with passages 34, 36, and 38, respectively, on one end of the line of modular blocks 20, and passages 46, 48, and 50 in another end block 44 can be aligned with passages 36, 34, and 38, respectively, on the other end of the line of modular blocks 20. The special end blocks 44 may be provided with one or more transverse passages 52. These transverse passages 52 allow structural elements constructed according to the principles of this invention to be connected in parallel and even prestressed in the transverse direction. Transverse tension members, not shown, can be positioned in the aligned transverse passages 52. These transverse tension members can be anchored and tensioned as described above with regard to tension members 40. In addition, crossmember blocks can be interposed between adjacent end blocks 44, the crossmember blocks can have passages alignable with the transverse passages 52 in the special end blocks 44 so that a transverse tension member can be extended therethrough and tensioned to form prestressed crossmember between the structural elements.

A countersunk pocket 54 is provided in the outside surface of each special end member blocks 44, coaxial with each of the passages 46, 48, and 50 therein. These pockets 54 receive anchors, not shown, on the ends of the tension members 40 by which the tension members 40 engage the special end block 44. The post-tensioning systems and the anchors used to tension the tension members 40 can be any of the systems well-known in the art, including those listed above.

The appropriate number of modular blocks 20 are arranged in a line with their passages 34, 36, and 38 aligned. An end block 44 is positioned at each end of the line of the modular blocks 20, with the passages 46, 48, and 50 therein aligned with the appropriate passages in the modular blocks 20. Tension members 40 are positioned in the aligned passages and engaged to each end block 44 with the appropriate anchors, which are received in the pockets 54. The tension members 40 may then be simultaneously or separately tensioned, for example by means of hydraulic stressing jacks, or any other suitable means. The tensioning of tension members 40 compresses the modular blocks 20, holding them together and putting the assembled structural element under a compressive prestress.

Figure 4:
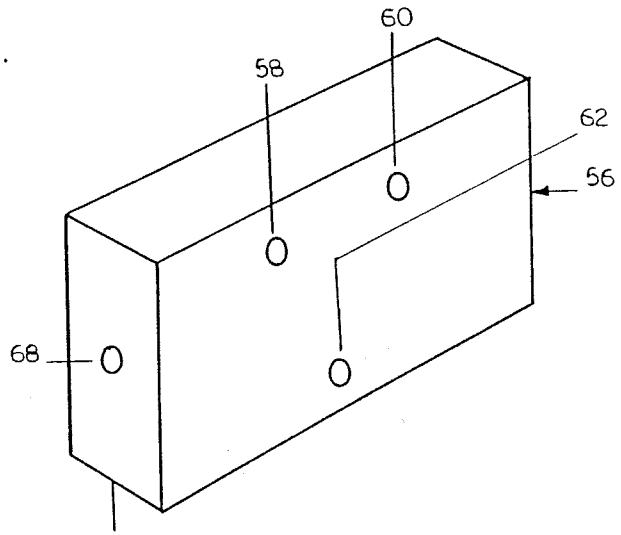
FIG. 4 is a perspective view from above of a special block with a transverse passage that can be incorporated into the structural element of this invention.
Figure 8:
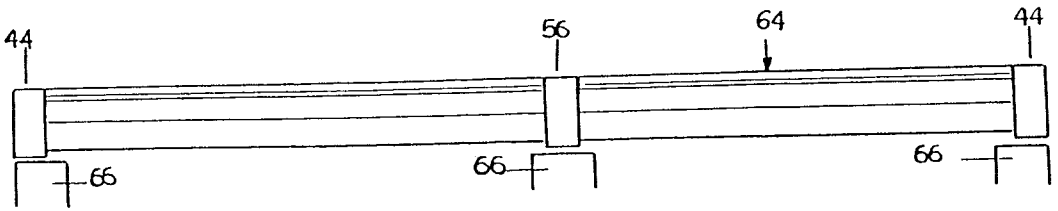
FIG. 8 is a side elevation view of a structural element constructed according to this invention, showing how it could be mounted to vertical piers, for example in a continuous roof.

A special block 56 is shown in FIG. 4. The special blocks 56 can be made from the same material as the modular blocks 20. The special blocks 56 have three axially extending passages 58, 60, and 62, arranged in a triangular pattern complementary to the arrangement of the passages 34, 36, and 38 in the modular blocks 20. The special blocks 56 can be included in a structural element constructed according to this invention in place of some of the modular blocks 20. The blocks 56 provide a point in the structural element intermediate the ends from which the element can be supported. For example, as shown in FIG. 8, a structural element 64 including a special block 56 and two end blocks 44 is mounted on three vertical piers 66.

Figure 6:
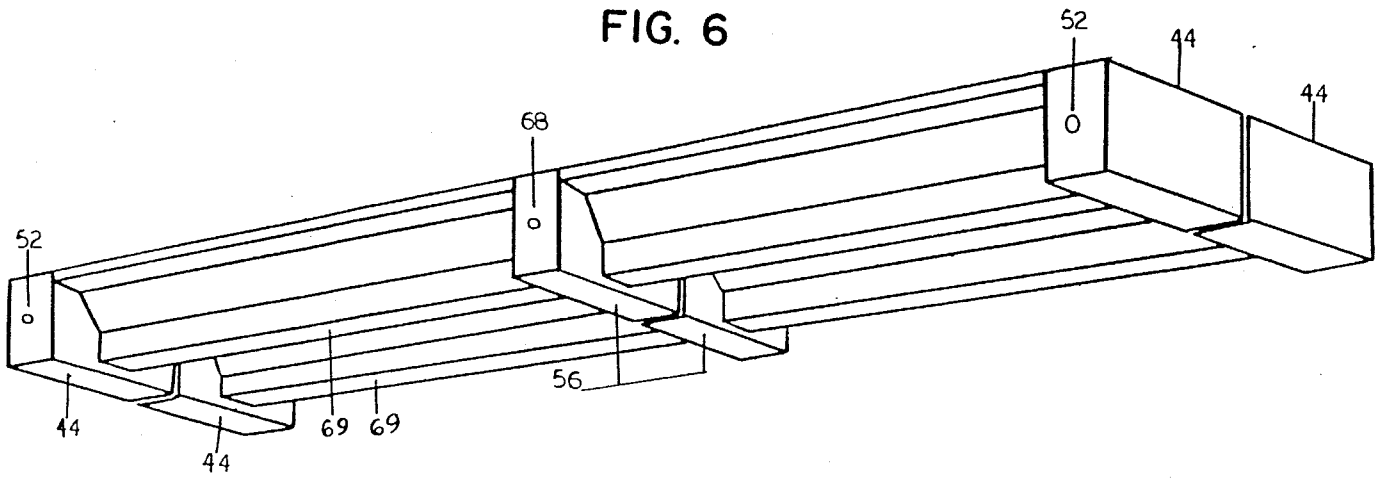
FIG. 6 is a perspective view from below of two parallel structural elements constructed according to this invention, showing how they can be connected.

The special blocks 56 may also be provided with one or more transverse passages 68. The transverse passages 68 allow the structural elements to be connected in parallel, and even prestressed in the transverse direction. This is illustrated in FIG. 6 where two structural elements 69 are shown extending generally parallel to each other. In addition to a plurality of modular blocks 20, each structural element 69 includes two end blocks 44 and a special block 56. The transverse passages 52 in adjacent end blocks 44 of the adjacent elements, and the transverse passages 68 in adjacent special blocks 56, are aligned. Transverse tension members, not shown, can be positioned in the aligned transverse passages. The transverse tension members can be anchored and tensioned, as described above, to compress the adjacent end blocks 44 and the adjacent special blocks 56 together, and put them under a compressive prestress. In addition, crossmember blocks can be interposed between adjacent special blocks 56 in adjacent elements to form prestressed crossmembers as described above.

Figure 5:
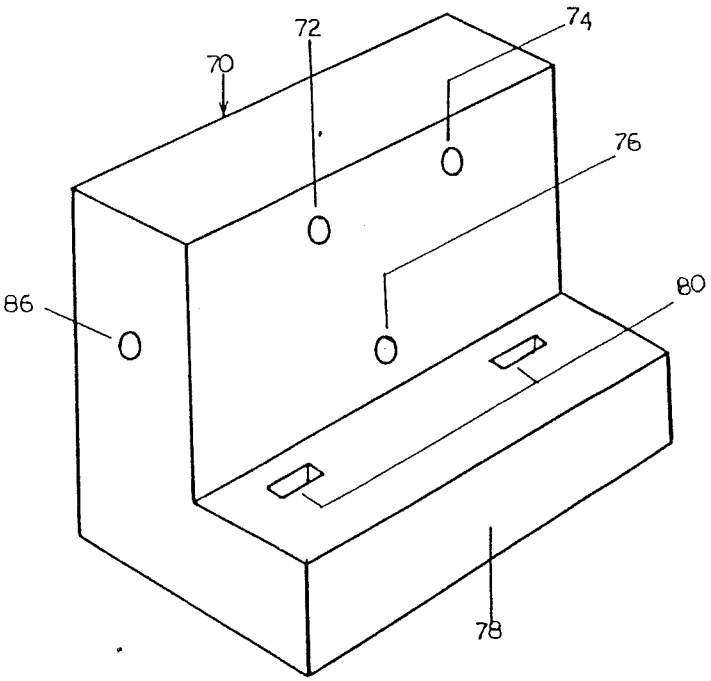
FIG. 5 is a perspective view from above of a special block with a mounting foot that can be incorporated into the structural element of the invention.
Figure 7:
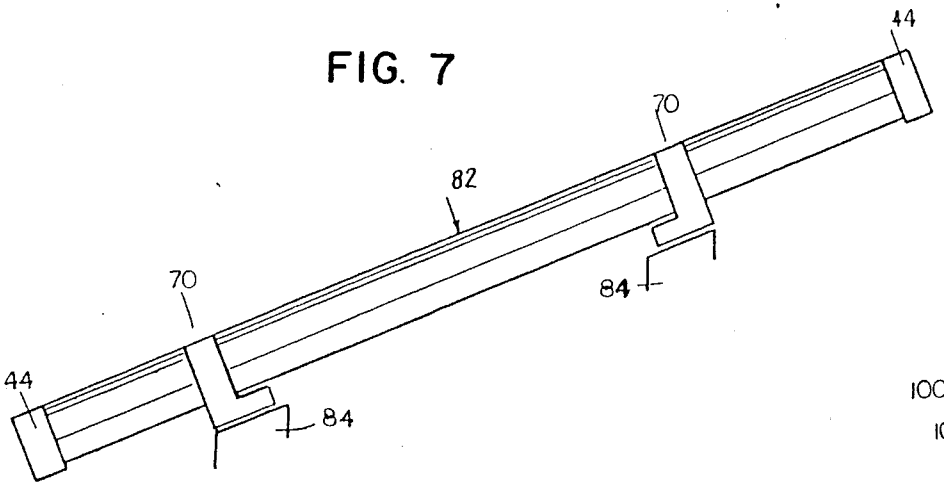
FIG. 7 is a side elevation view of a structural element constructed according to this invention, showing how it could be mounted to vertical piers, for example as a valley roof with a fixed support and over hanging system.

Another special block 70 is shown in FIG. 5. The special block 70 can be made from the same material as the modular blocks 20. The special blocks 70 are similar to the special blocks 56, having three axially extending passages 72, 74, and 76 arranged in a triangular pattern complementary to the arrangement of passages 34, 36, and 38 in the modular blocks 20. However, the blocks 70 also include a depending mounting foot 78. This mounting foot 78 has mounting slots 80. The blocks 70 can be included in a structural element constructed according to this invention in place of some of the modular blocks 20. The blocks 70 provide a point in the structural element intermediate the ends from which the element can be supported. For example, as shown in FIG. 7, a structural element 82 including blocks 70 and two end blocks 44 is mounted on vertical piers 84. The mounting feet 78 are secured to the piers 84 with fasteners (not shown) extending through the mounting slots 80. The blocks 70 may also be provided with one or more transverse passages 86. The transverse passages 86 allow the elements to be connected in parallel, and even prestressed in the transverse direction. In addition, crossmember blocks can be interposed between adjacent blocks 70 in adjacent elements to form prestressed crossmembers as described above.

Figure 12:
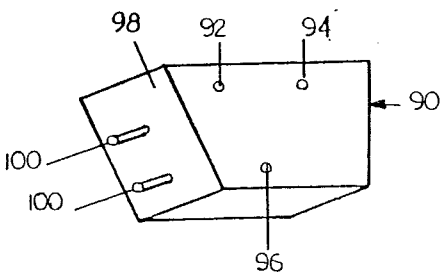
FIG. 12 is a partial perspective view from below of a special block with projecting threaded studs that can be incorporated into the structural element of this invention.
Figure 9:
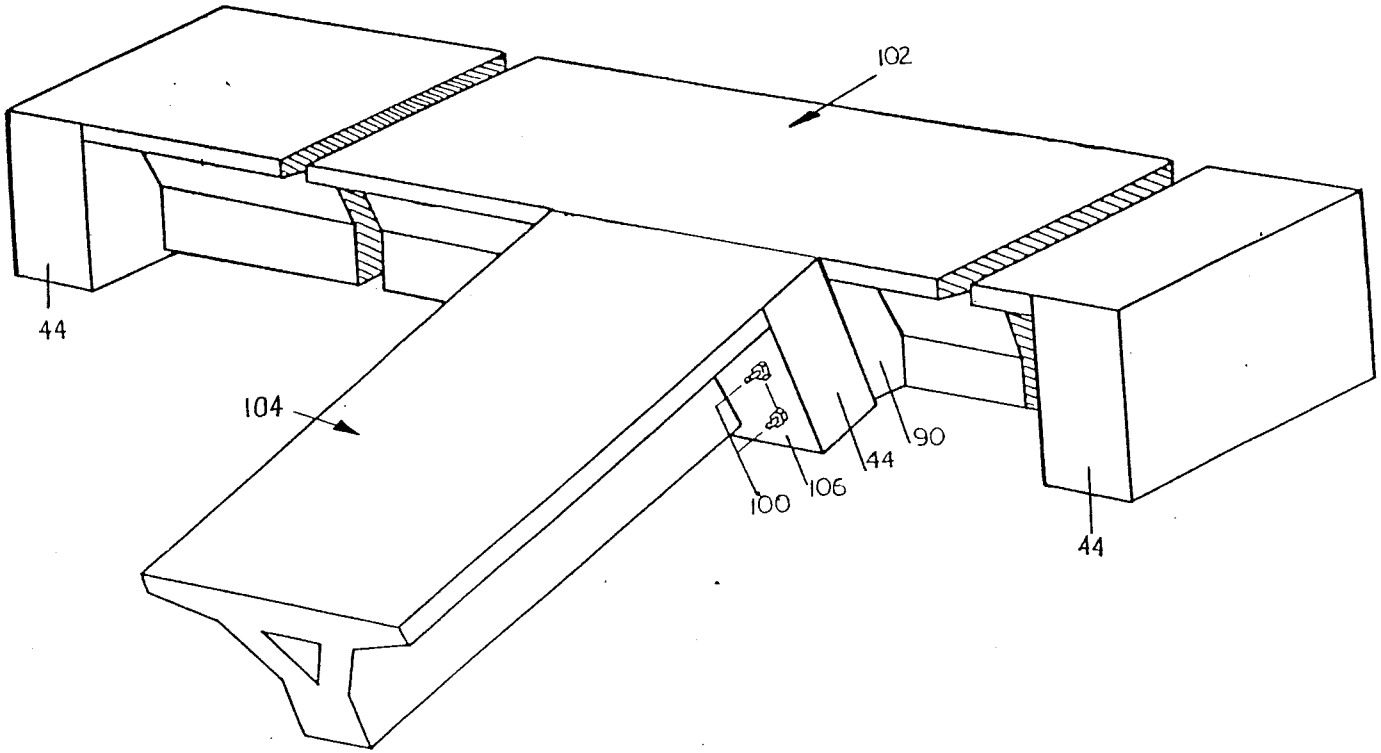
FIG. 9 is a partial perspective view from above of two structural elements constructed according to this invention, showing how they could be connected, for example to support a roof.

Another special block 90 is shown in FIG. 12. The special blocks 90 can be made from the same material as the modular blocks 20. The special blocks 90 have three axially extending passages 92, 94, and 96 arranged in a triangular pattern complementary to the arrangement of the passages 34, 36, and 38 in the modular blocks 20. The special blocks 90 have a downwardly facing sloped face 98, the slope of the face 98 can be varied. Threaded studs 100 project from face 98. The special blocks 90 can be included in a structural element constructed according to this invention in place of some of the modular blocks 20. The special blocks 90 provide a point in the structural element intermediate the ends at which other elements can be joined. For example, a structural element 102 including the special blocks 90 and two end blocks 44 is shown in FIG. 9. A second element 104 having an end block 44 is shown engaged to element 102 at the special block 90, the end block 44 on the second element 104 having holes for receiving the studs 100 and being secured thereto with nuts 106.

Figure 10:
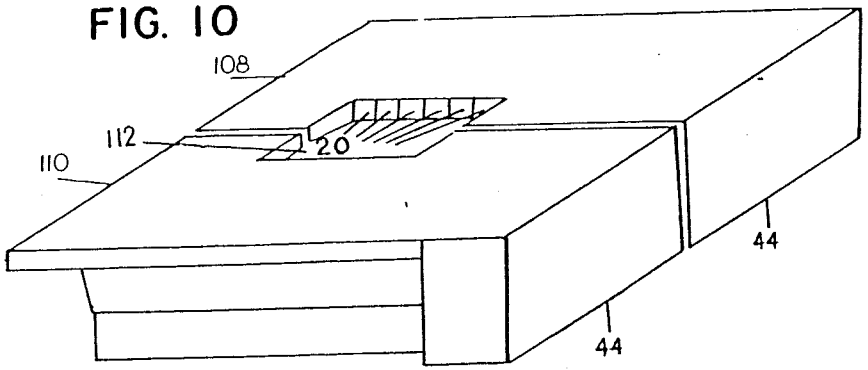
FIG. 10 is a partial perspective view from above of two parallel structural elements constructed according to this invention, showing an opening between them.

In FIG. 10, two structural elements 108 and 110 are shown positioned generally parallel to each other. A portion of the constituent blocks 20 of each of the elements 108 and 110 are removed to define a opening 112 therebetween. Opening 112 would be provided, for example, for the receiving a chimney, ducts, utility pipes or conduits, or the like.

Figure 11:
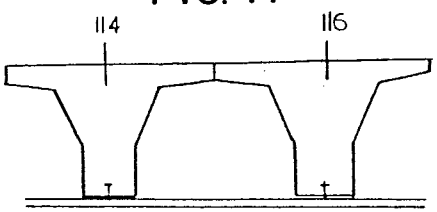
FIG. 11 is a cross-sectional of two parallel structural elements constructed according to this invention, showing how a ceiling can be connected to their underside.

In FIG. 11, two structural elements 114 and 116 are shown in cross-section to illustrate the mounting of a ceiling surface to the underside of the elements 114 and 116.

There are various changes and modifications which may be made to inventor's invention as would be apparent to those skilled in the art. However, these changes or modifications are included in the teaching of inventor's disclosure, and it is intended that the invention be limited only by the scope of the claims appended hereto.

I claim:

1. A horizontally extending modular structural element constructed from a plurality of modular blocks, the element comprising:

a plurality of modular blocks, each block having a generally hollow T-shaped cross-section, the block comprising a base section having opposite ends and comprising two oppositely extending colinear legs terminating respectively at said opposite ends and defining a flat generally horizontal top surface extending between said opposite ends; a stem section having outer sides spaced inwardly from said opposite ends and extending downwardly from the center of the bottom of the base section, the stem section having a compound configuration comprising a first portion having inner sides and upper sections of said outer sides tapering downwardly and inwardly from the base section, the stem section having a second portion below the first portion having generally vertical parallel lower sections of said outer sides; an axial hole defined at least in part by the inner sides extending through the first portion of the stem section; and, at least three axial passages for receiving tension members, the three passages being arranged in a triangular pattern around the axial hole, a side of this triangular pattern being parallel to the flat top surface of the block; the plurality of blocks being arranged in a line parallel to the three passages and of uniform cross section, the line of blocks having first and second ends with their axial passages aligned to define three triangularly oriented compound passages through the blocks extending from the first end to the second end for receiving tension members; a tension member extending through each compound passage in the blocks; and means for engaging the tension member to the block at each end of the line, the tension member exerting a compressive force on the blocks, holding the blocks together and putting the blocks under a compressive pre-stress.

2. The block of claim 1 further comprising a plurality of smaller axial holes in the block generally surrounding the axial hole.

3. The block of claim 1 where the axial hole in the block is generally triangular with one side of the triangular shaped hole parallel to the top of the "T" and the other two sides tapering inwardly generally parallel to the upper sections of the outer sides.

4. The element of claim 1 further comprising an end block at each end of the line of the modular blocks, each end block having an axial passage corresponding to each axial passage in the modular blocks and arranged to be aligned therewith, the end blocks further comprising a recessed pocket at each axial passage in the end member.

5. The element of claim 4 wherein each end block further has at least one transverse passage therethrough.

6. The element of claim 1 further comprising at least one special block intermediate the ends, the special block having a transverse passage therethrough.

7. The element of claim 1 further comprising at least one special block intermediate the ends, the special block having a depending mounting foot.

8. The element of claim 7 wherein the special block has a transverse passage therethrough.

9. The element of claim 1 further comprising at least one special block intermediate the ends, the special block having an outwardly projecting threaded stud.

10. The element of claim 1 further comprising at least one special block intermediate the ends of the element, the special block having a sloped side for engaging and mounting a second element to extend generally transversely from the element.

* * * * *